US008186376B2

(12) United States Patent
Shuval

(10) Patent No.: US 8,186,376 B2
(45) Date of Patent: May 29, 2012

(54) LIQUID PURGE VALVE

(75) Inventor: Meir Shuval, D.N. Ramat Hagolan (IL)

(73) Assignee: A.R.I. Flow Control Accessories Ltd., D.N. Ramat Hagolan (IL)

( * ) Notice: Subject to any disclaimer, the term of this patent is extended or adjusted under 35 U.S.C. 154(b) by 664 days.

(21) Appl. No.: 12/309,529

(22) PCT Filed: Jul. 19, 2007

(86) PCT No.: PCT/IL2007/000917

§ 371 (c)(1),
(2), (4) Date: Jan. 22, 2009

(87) PCT Pub. No.: WO2008/012806

PCT Pub. Date: Jan. 31, 2008

(65) Prior Publication Data

US 2009/0194725 A1 Aug. 6, 2009

Related U.S. Application Data

(60) Provisional application No. 60/832,951, filed on Jul. 25, 2006.

(51) Int. Cl.
*F16K 31/18* (2006.01)

(52) U.S. Cl. ..... 137/397; 137/398; 137/429; 137/437; 137/448; 137/451

(58) Field of Classification Search ..... 137/395–398, 137/409, 429, 434, 437, 448, 451, 590, 590.5
See application file for complete search history.

(56) References Cited

U.S. PATENT DOCUMENTS

| | | | | |
|---|---|---|---|---|
| 444,713 | A * | 1/1891 | Roberts et al. | 137/214 |
| 2,756,767 | A * | 7/1956 | Lowery | 137/397 |
| 5,450,900 | A | 9/1995 | Schalla et al. | |
| 5,501,279 | A | 3/1996 | Garg et al. | |
| 5,641,272 | A | 6/1997 | Harrold | |
| 6,367,555 | B1 | 4/2002 | Senyard, Sr. et al. | |

FOREIGN PATENT DOCUMENTS

| | | |
|---|---|---|
| EP | 0 297 683 A1 | 1/1989 |
| EP | 0 619 433 A1 | 10/1994 |
| GB | 2 276 700 A | 10/1994 |

* cited by examiner

*Primary Examiner* — Craig Schneider
(74) *Attorney, Agent, or Firm* — The Nath Law Group

(57) ABSTRACT

A liquid purge valve comprising a housing for sealingly fitting at an uppermost end of a substantially vertical pipe, an outlet tube extending from the housing and projecting into the pipe, an outlet port fitted with a sealing boundary and sealable by a sealing member pivotally secured within the housing so as to pivotally displace between a closed and an open position, a biasing member biasing the sealing member into its open position, and a mass articulated to the sealing member and extending downwards into the pipe. The mass applies a force at an opposite direction of the biasing member such that the resultant force acting on the sealing member determines its position such that when water level rises within the pipe the sealing member displaces into the open position.

17 Claims, 5 Drawing Sheets

LIQUID PURGE VALVE

FIELD OF THE INVENTION

This invention relates to liquid purge valves and more particularly to such valves fitted for automatically discharging liquids from a gaseous/liquid environments, such as well bores.

BACKGROUND OF THE INVENTION

A common method for production of Methane gas trapped in a coal bed under a water aquifer is to flow it in large diameter pipes, under well pressure or by the aid of suitable pumps and blowers to collecting and storage reservoirs. However, as the gas passes through the liquid layer of the earth, an amount of water is carried by the gaseous substance, forming a mixture of gas and liquid which may interfere in the normal fluid flow of the gaseous material damaging the pumping gear and its accessories (which are often, but not necessarily, gas operated). It is thus an aim to remove such liquids and for that purpose different devices and methods have been provided.

According to one common method, a plurality of substantially liquid traps are provided in the form of discharge vertical columns fixed to the main gas flow pipe, whereby the water can be manually discharged therefrom. Said columns are distributed along the route of the main pipe and are distributed according to topographic and other considerations.

One problem with such liquid traps is the need for manual labor to reach each and every such trap and manually open it to discharge the trapped liquid which is emitted from the vertical column under pressure of the flowing gas. This operation obviously requires considerable time and man power (such manual draining may take place once a week or even every day, depending on different considerations), which at remote areas is problematic, and even more so under extreme weather conditions.

It is appreciated that in most cases there is no practical indication referring to the amount of liquid in a respective trap and that each such opening also discharges an unavoidable amount of gas, wasted to the atmosphere. The indication for the operator to close the discharge outlet of the liquid trap is the presence of gas, namely a solution of bubbles and water.

Still, in cold weather there is a serious problem in which water freezes within the liquid trap columns, and not withstanding the fact that the columns may be buried as deep as about 2 meters below ground level, freezing occurs and these may cause damage to the pipes.

It is also appreciated that the solution carries particles such as, coal-bed particles, sand and rock particles, piping debris (metal or plastic), etc.

Various patents are concerned with methods and systems for gas lift from wells and other patents are concerned with surface controlled liquid removal methods and systems for gas producing wells. The liquid concerned is typically water.

For example, U.S. Pat. No. 6,367,555 discloses a method of producing an oil, water, and gas well using a gas carrier/transport system to remove produced liquids and contained solids by altering the flow regime of the production fluids towards or into a flow regime in which gas is the continuous fluid (i.e., the rate of upflowing gas in the well is efficiently high in comparison with liquid production flow to generate plug flow, slug flow, froth flow, foam flow, annular flow, spray flow, and/or mist flow.) This is accomplished by use of supplemental gas flow (hydrocarbon or non-hydrocarbon) and/or stimulation of the production sand gas flow with a reduced pressure drop across the well once near or in a gas-continuous flow regime. This invention can be applied to any gas, oil, and/or water well with insufficient formation gas pressure to prevent liquid buildup within the well during production. The present invention utilizes a second production pipe (or the annulus between the casing and the pipe), sized to transport compressed gas from the wellhead area down into the production liquid and into the production pipe. This flow of gas will cause the well fluids to flow up the pipe by approaching or entering a gas-continuous flow regime. Once the new flow regimes have been achieved in the production pipe, supplemental gas may no longer be necessary due to increased formation gas flow without the high pressure drop which had been due to the column of liquid in the production pipe.

U.S. Pat. No. 5,501,279 discloses an apparatus and method for continually and intermittently removing water from a wellbore which penetrates a solid carbonaceous subterranean formation, such as a coalbed, while concurrently removing methane from the formation. The apparatus utilizes a linear access means which facilitates switching the apparatus from a continuous water removal mode of operation to an intermittent water removal mode of operation using wireline retrievable tools.

It is thus an object of the present invention to provide a liquid purge valve for automatic drain of liquid from a gas/liquid mixture.

SUMMARY OF THE INVENTION

It is an object of the present invention to provide a liquid purge valve, in particular, though not restricted to, for use in the natural gas manufacturing industry.

The invention is concerned with an autonomous, automatic liquid purge valve, in particular for draining of water from a gas-water mixture emerging from the ground under pressure, e.g. at methane gas manufacturing sites.

However, a valve according to the present invention is suited for fitting at other sites for draining of liquids from mixed gas-liquid environments, e.g. steam facilities, etc.

The valve according to the invention is suited for fast and readily retrofit over existing liquid purge pipes extending from a main gas pipe (a 'riser')

According to the present invention there is provided a liquid purge valve comprising a housing for sealingly fitting at an uppermost end of a substantially vertical pipe, an outlet tube extending from said housing and projecting into said pipe, an outlet port fitted with a sealing boundary and sealable by a sealing member pivotally secured within the housing so as to pivotally displace between a closed/sealed and an open position, a biasing member biasing the sealing member into its open position, a mass articulated to said sealing member and extending downwards into the pipe, and where said mass applies a force at an opposite direction of said biasing member, whereby the resultant force acting on the sealing member determines its position such that when water level rises within the pipe the sealing member displaces into the open position.

The sealing member is fitted with a moment lever articulated at an end thereof distal from said pivot with an arm articulated to the mass and to the biasing member. This arrangement is useful for ensuring functioning of the sealing member, namely displacing into and from the sealing position thereof.

Any one or more of the following feature or designing characteristics may be applied to the valve according to the present invention:

The mass extends till about several centimeters from a lowermost end of the pipe;

The sealing member is fitted with a resilient pealing seal for gradually detaching from the sealing boundary of the outlet port;

The pealing seal is a strip-like resilient member anchored at one end thereof to the housing and at an opposite end thereof to the sealing member;

The tube extends into the pipe till about several centimeters above the mass;

The mass is articulated to the sealing member by a cable extending through at least a portion of the tube;

The outlet port comprises an outlet nozzle designed for dispersing water emitted therefrom, to thereby prevent massive wetting of the ground surface adjacent the device;

The outlet port comprises an outlet nozzle fitted with an audio signaling device activated by a fluid flow therethrough. In addition, or alternatively a visual indicator may be fitted, e.g. in the form of a 'flag' projecting from the housing;

The housing is fitted with an internal 2" threaded fitting for mounting on said pipe. This is based however on the finding that a majority of such pipes are fitted with a 2" external thread. It is appreciated that other types and sized of couplings are available too;

The housing further comprises a manual override for displacing the sealing member into the open position;

The outlet port has a generally rectangular cross section, wherein the pealing seal displaces about a long axis of the outlet port;

The length of the cable is adjustable, such that the valve may be easily adapted to fit to a pipe of any length. For the same reason, it is advantageous that the length of the pipe is adjustable;

At the closed, sealing position the moment lever applies a sealing force over the sealing member to sealingly engage the sealing boundary. The lever is formed with a sealing seating corresponding with a substantial portion of the resilient seal, so as to ensure tight and adequate sealing engagement over the sealing boundary;

According to another aspect of the present invention, there is provided a liquid purge valve accessory comprising a housing for sealingly fitting at an uppermost end of a substantially vertical pipe, an outlet port fitted with a sealing boundary and sealable by a sealing member pivotally secured within the housing so as to pivotally displace between a closed and an open position, a biasing member biasing the sealing member into its open position, said sealing member being fitted with a moment lever articulated at an end thereof distal from said pivot with an arm, whereby said biasing member is articulated at one side thereof and a mass is attachable to another side thereof so as to generate a force at an opposite direction of said biasing member; and further the housing is fittable with an outlet tube extendable from said housing and projecting into said pipe. The valve thus is provided such that the tube and the mass are separate therefrom and wherein the length of the cable supporting the mass is adjustable, and where the tube is of adjustable length as well.

BRIEF DESCRIPTION OF THE DRAWINGS

In order to understand the invention and to see how it may be carried out in practice, an embodiment will now be described, by way of non-limiting example only, with reference to the accompanying drawings, in which.

DETAILED DESCRIPTION OF AN EMBODIMENT

Figure 1:
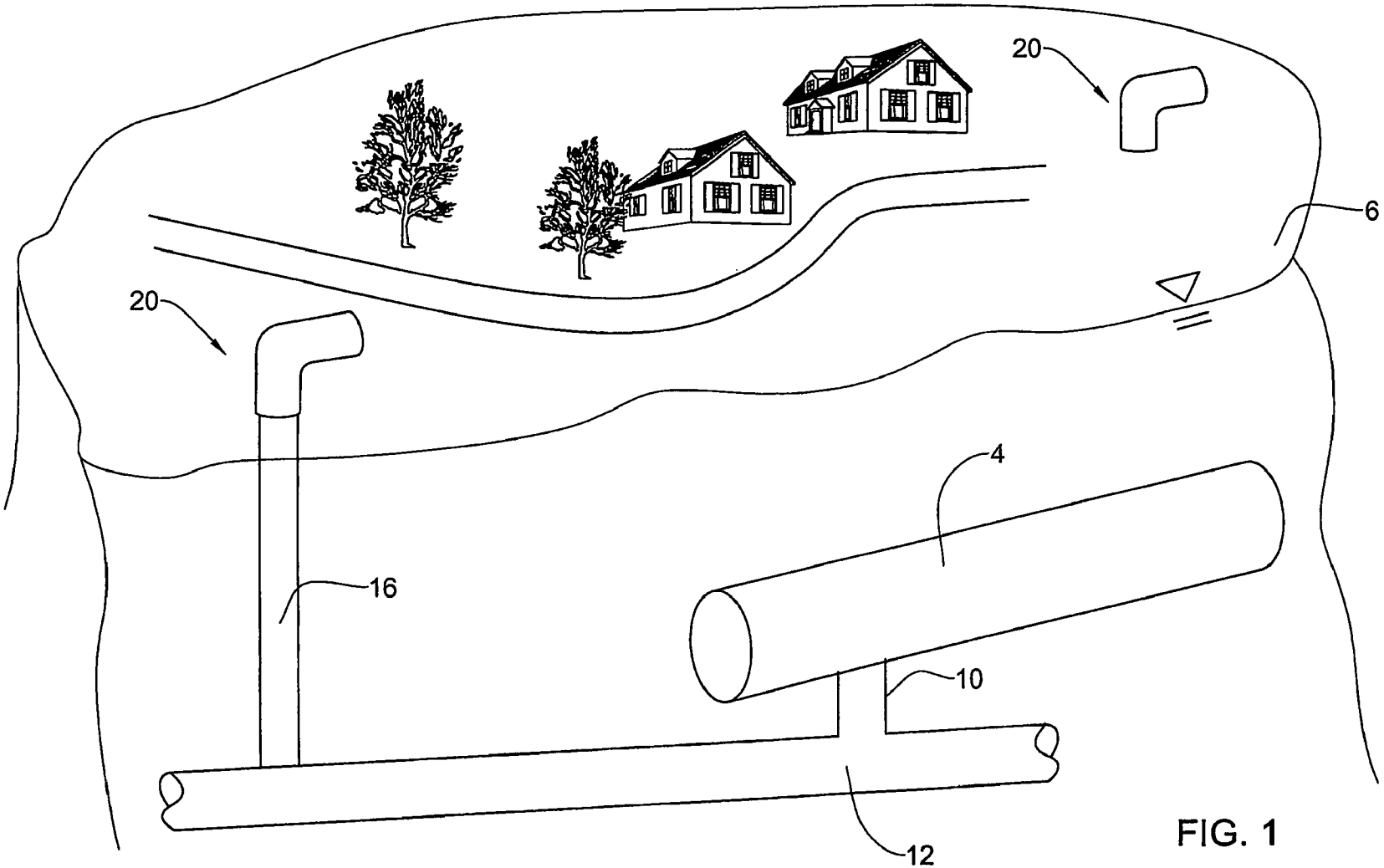
FIG. 1 is a schematic sectioned illustration through a piece of land illustrating Methane production site.

Turning first to FIG. 1 there is illustrated a Methane recovery site for collecting Methane gas from a coal bed wherein a large diameter main pipe 4 e.g. having a diameter of about 12 to 16 inch flows at a depth of about 5 ft. below ground surface 6, said pipe 4 collecting the Methane gas from the coal bed and transferring it. The gas contained under pressure and the by aid of suitable pumping stations (not shown) to suitable collecting and storage reservoirs (not shown).

Extending below the main pipe 4 there is a liquid drainage system formed within an intermediate pipe 10 extending to a liquid collecting pipe 12, the latter fitted with a plurality of vertical liquid purge tubes 16 being substantially vertical and projecting above ground surface 6, each such purge tubes 16 fitted at its upper end, above ground surface with a liquid purge valve generally designated 20 to be discussed hereinafter in further details.

The purge tube 16 rises from a depth of approximately 8 ft. and commonly, this tube is a two inch diameter pipe, as know per se.

Figure 2A:
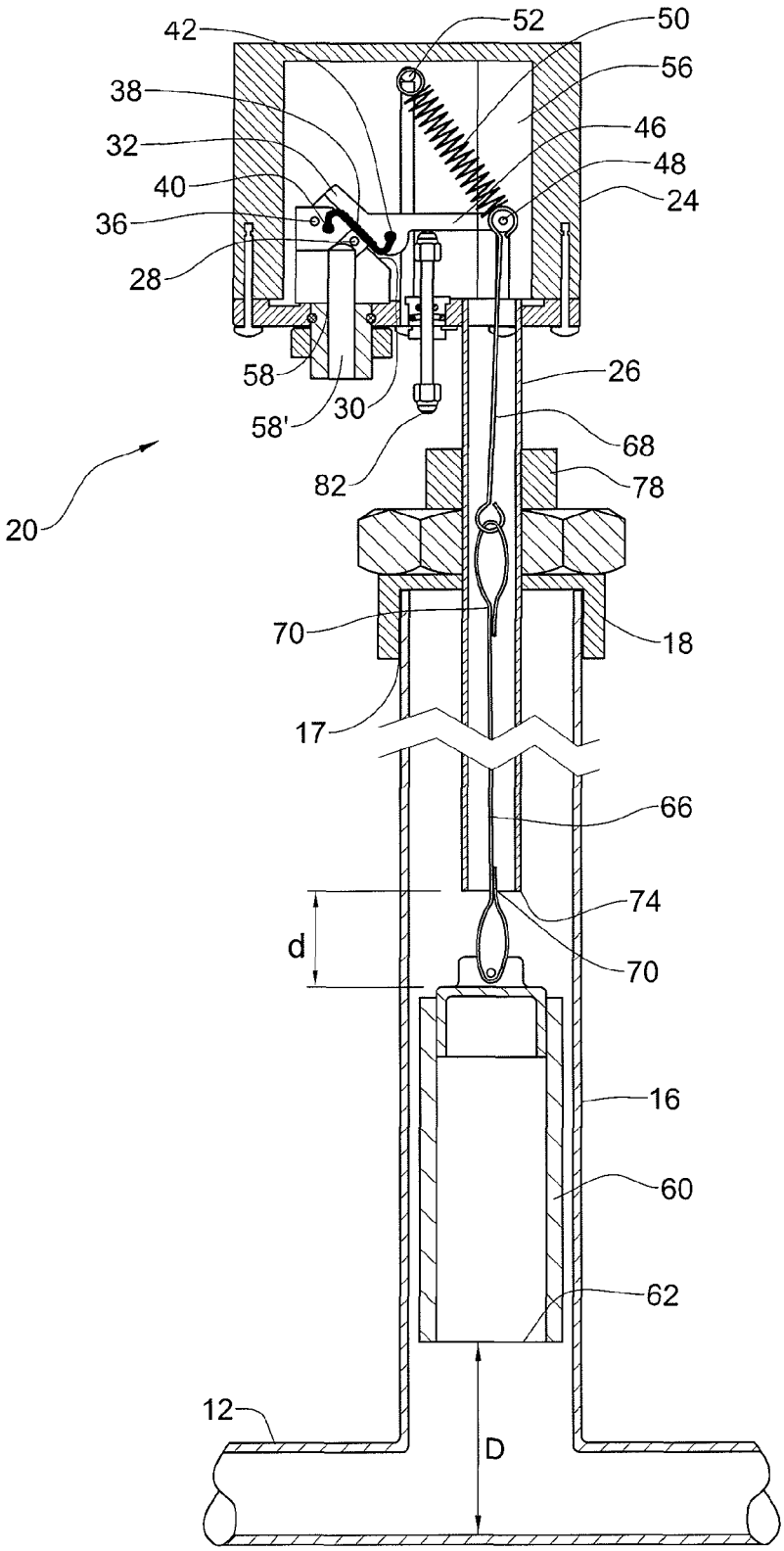
FIG. 2A is a longitudinal sectional view of a liquid purge pipe fitted with a purge valve in accordance with the present invention, the valve in its closed position.
Figure 2B:
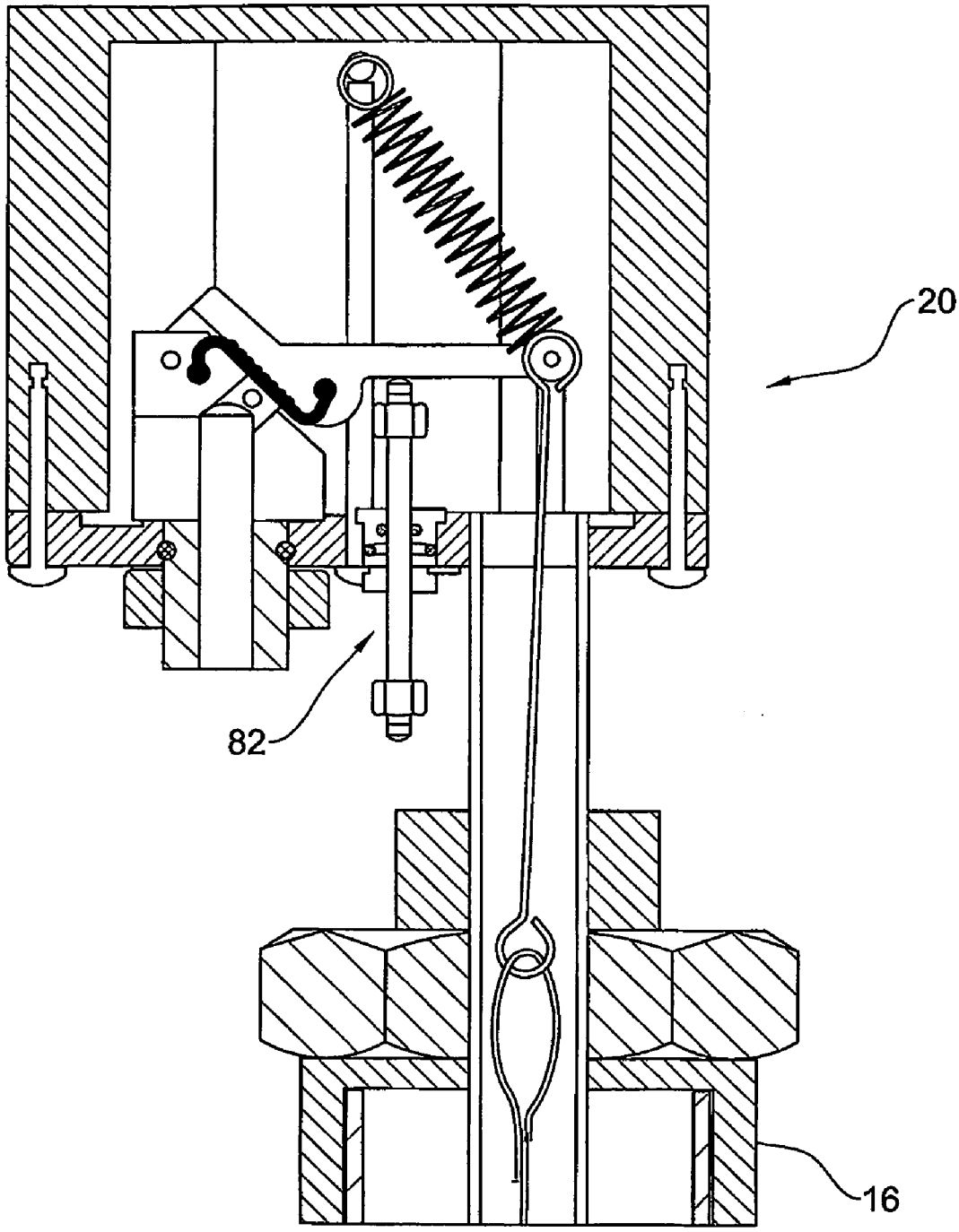
FIG. 2B is an enlargement of the valve illustrated in FIG. 2A.

Further attention is directed to FIGS. 2A and 2B for understanding the structure, assembly and operation of the liquid purge valve 20 in accordance with the present invention.

The liquid purge valve 20 comprises a housing 24 is formed with an outlet tube 26 extending into the liquid purge pipe 16 in a sealingly articulated manner by means of screw threaded fastener 18 which in the typical example is a two inch threaded fastener for screw coupling over the corresponding threaded neck 17 of the liquid purge pipe 16. The liquid purge valve 20 further comprises an outlet port 28, which in the particular example has a substantially rectangular cross-section and is fitted with a sealing boundary 30. A sealing member 32 is pivotally hinged at 36 with respect to the outlet port, said sealing member being fitted with a peelable seal 38 articulated at 40 to the housing and at 42 to the sealing member. The sealing member 32 is fitted with a moment arm 46 with a distal end thereof 48 being articulated to a tension spring 50 fixed at its opposite end 52 to a member rigid within the housing 24, so as to apply a biasing force to displace the sealing member 32 into its open position, as will be discussed hereinafter.

The seal 30 is biased into sealing engagement of the outlet port 28, for preventing liquid flow between an inside space 56 within the casing and an outlet nozzle 58. Type sealing engagement of the seal 30 is facilitated by pressure applied thereon by means of the sealing member 32 which is normally biased in a clockwise direction under the biasing effect of a mass 60 in the form of a float fitted with an open base 62, suspending through a cable 66 extending through the outlet tube 26 and eventually articulated to the distal end 24 of the pivot arm 46 by means of a link 68.

As seen in FIG. 2A, the mass/float 60 extends to a depth D which typically is several centimeters from the lowermost portion of the purge tube 16. Setting the length of cable 66 is facilitated by fasteners 70 for adjusting the suitable length thereof, in relation to the required length of purge tube 16.

The lowermost end 74 of the outlet 26 extends at a height d above the mass/float 60 where this distance does not exceed several centimeters. The distance d may be regulated by loosening the top nut 78 from the fitting 18 allowing axial displacement of the outlet tube 26 for adjustment of the distance d. However, it is appreciated that the fitting between the outlet tube 26 and the coupling 18 and the top nut 78 is a fluid tight arrangement.

Figure 4:
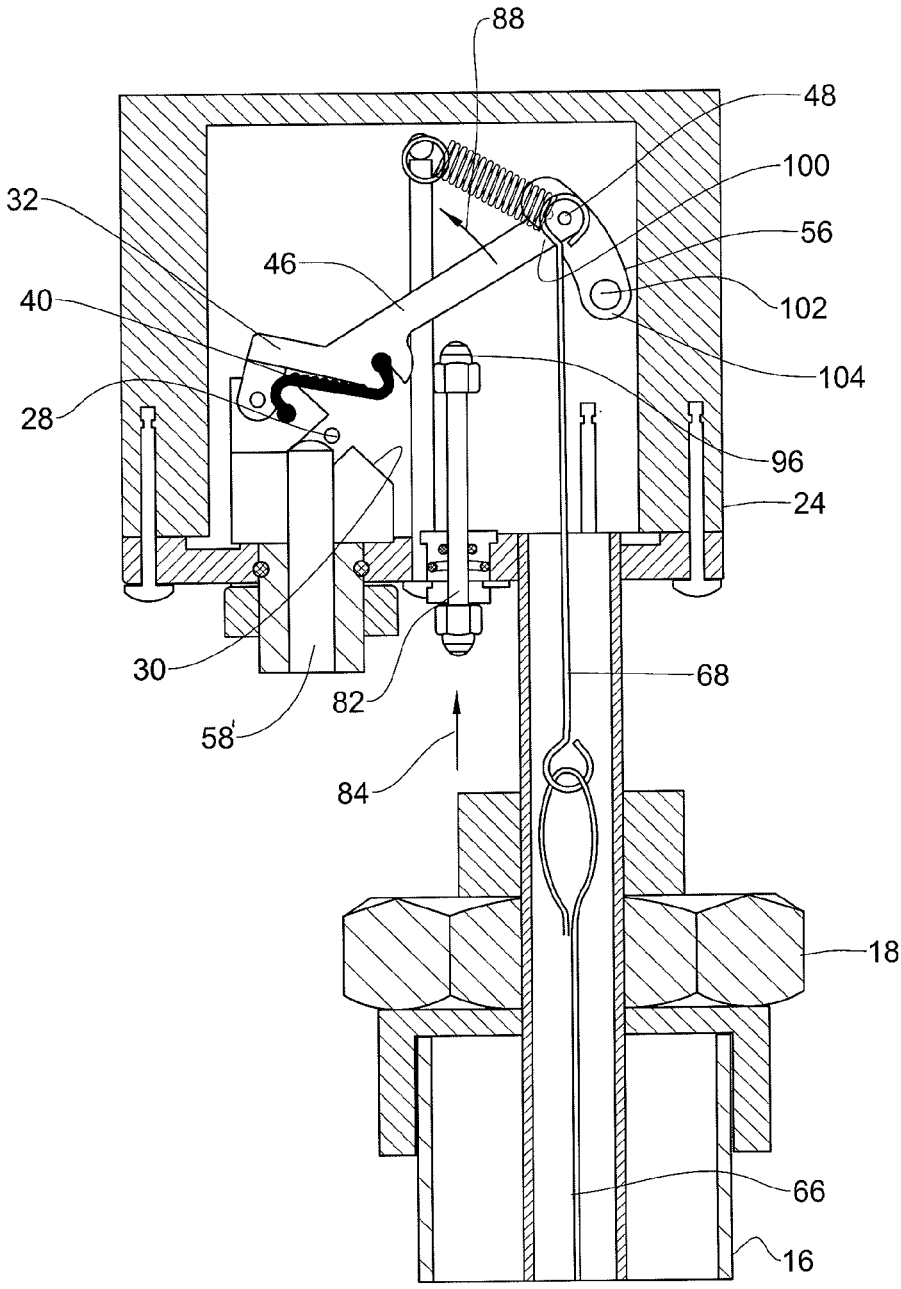
FIG. 4 illustrates the valve in its open position due to manual override.

It can further be seen in the drawings, the liquid purge valve 20 is fitted with a manual override plunger 82 which is manually depressible in direction of arrow 84 in FIG. 4 to thereby override the system and displace the sealing member 32 into its open position (FIG. 4), as will be discussed hereinafter.

The arrangement is such that when at the normal state the gas purge valve 20 is in its closed position as in FIGS. 2A and 2B wherein the mass 60 overcomes the biasing effect of spring 50. However, upon liquid rising within the purge tube 16, the mass 60, acts as a float and displaces upwardly under buoyancy forces wherein together with the biasing effect of spring 50 the sealing member 32 displaces into its open position in direction of arrow 88 (FIGS. 3 and 4) wherein the sealing seal 40 disengages from the sealing boundary 30 opening the flow path so as to facilitate liquid flow through the space 56 of the valve and via outlet port 28 and then out to the atmosphere through outlet nozzle 58.

It is appreciated that the fluid flowing through pipe 12 is a gas-liquid mixture and thus, at a certain stage after purging liquid from the tube 16 gas pressure is built up within the purge tube 16, above the mass 60 causing the water to displace downwards, together with the mass 60 whereupon the sealing member 32 displaces into its closed position (FIGS. 2A and 2B) thereby sealing the outlet port. The loss of buoyancy after the liquid is expelled from purge tube 16 cause gravity to pull the mass 60 downwards, causing the sealing member 32 to close which together with the gas pressure in the space 56 seals the peeling seal 38 against the sealing boundary 30 thereby sealing the outlet port. Any liquid remaining in the upper part of the tube 16 settles downward and is expelled in the next cycle.

However, upon liquid rising within the purge tube 16 the valve 20 is spontaneously displaced into its open position often in a pulsating manner until a steady state is reached.

It is appreciated that all components of the liquid purge system should be fluid tight e.g. coupling of coupler 18 with the tube 16, fitting between the outlet tube 18 and the coupling 18 and top nut 78, etc., so as to ensure proper pressure build up within the tube 16.

Figure 3:
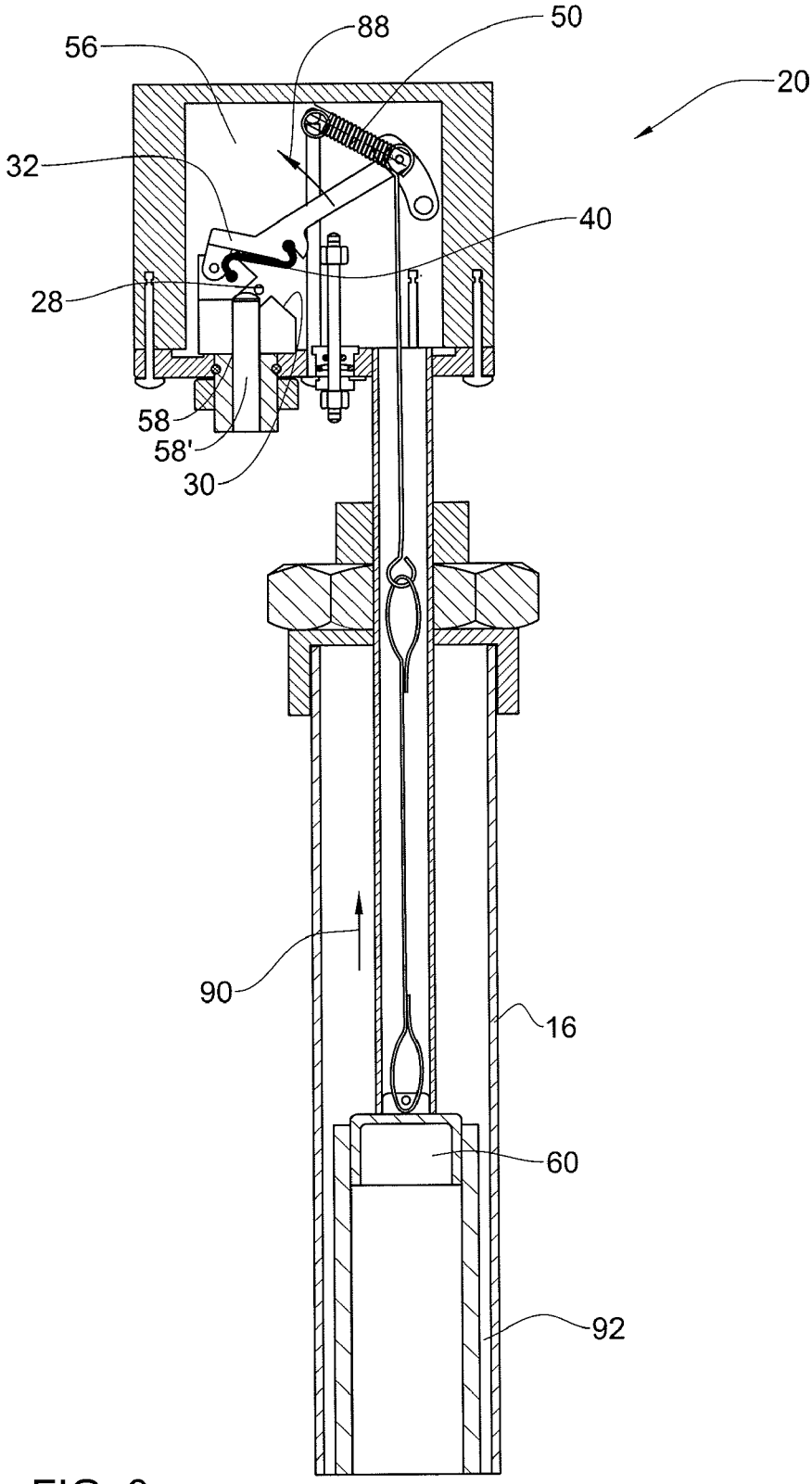
FIG. 3 illustrates the valve in its opened position.

In the embodiment of FIG. 3, the liquid purge valve 20 illustrated in its open position after the mass 60 is displaced upwardly in direction of arrow 90 under the water level 92 rising within the purge tube 16. The sealing member 32 pivotally displaces in direction of arrow 88 assisted by the retracting force applied by coil spring 50, thereby opening the liquid flow path between the space 56 of the valve and the outlet nozzle 58.

It can further be seen in FIG. 3 the outlet nozzle 58 is fitted with an acoustic signaling device, e.g. a whistle 58' which under the fluid flowing through yields an acoustic signal whereby the signal may be easily picked up by an official passing by to determine whether the valve is properly operative without the need to closely examine the operation of the valve.

At times, it may be desired to check proper functioning of the valve 20 or to purge gas/water from the purge tube 16. For this purpose, a manual override plunger 82 is provided whereupon displacing it in direction of arrow 84 (FIG. 4) simply by depressing, its distal ends 96 bears against the arm lever 46 and displacing it in direction of arrow 88, into the open, unsealed position, against the gravity force acting on the mass 60.

According to another embodiment of the invention, the distal end 48 of the lever arm 46 is fitted with a magnetic piece 100 for displacing an indicator 102 fitted therewithin an indicator window 104 fitted on the outside surface of the housing 24 in a liquid light manner. The window is such that pivotal displacement of arm 46 entails corresponding displacement of the indicator 102 (which is a magnetic element too) to thereby provide a visual indication corresponding with the actual position of the liquid purge valve 20, i.e. being closed or opened, respectively.

It is appreciated that the liquid purge valve 20 in accordance with the present invention is suitable for fitting as an add-on device as it is fully modular whereby the length of the outlet tube 26 may be easily adjusted either by trimming or by axially displacing, as discussed hereinabove, and similarly, the length of the cord/cable 66 extending therethrough may be easily adjusted to obtain appropriate height of the depending mass 60.

It is also appreciated that the pulsating purging act, as discussed hereinabove, has the advantage of rinsing pipe 12 to facilitate discharging of end debris extending in the system.

While there has been shown a preferred embodiment of the invention, it is to be understood that many changes may be made therein without departing from the spirit and the scope of the invention mutatis mutandis.

The invention claimed is:

1. A liquid purge valve accessory comprising a housing for sealingly fitting at an uppermost end of a substantially vertical pipe, an outlet port fitted with a sealing boundary and sealable by a sealing member pivotally secured within the housing so as to pivotally displace between a closed and an open position, a biasing member biasing the sealing member into its open position, said sealing member being fitted with a moment lever articulated at an end thereof distal from said pivot with an arm, whereby said biasing member is articulated at one side thereof and a mass is attachable to another side thereof so as to generate a force at an opposite direction of said biasing member; and further the housing is fittable with an outlet tube extendable from said housing and projecting into said pipe.

2. A liquid purge valve comprising a housing for sealingly fitting at an uppermost end of a substantially vertical pipe, an outlet tube extending from said housing and projecting into said pipe, an outlet port fitted with a sealing boundary and sealable by a sealing member pivotally secured within the housing so as to pivotally displace between a closed and an open position, a biasing member biasing the sealing member into its open position, a mass articulated to said sealing member and extending downwards into the pipe, and where said mass applies a force at an opposite direction of said biasing member, whereby the resultant force acting on the sealing member determines its position such that when water level rises within the pipe the sealing member displaces into the open position.

3. A liquid purge valve according to claim 2, wherein the mass extends till about several centimeters from a lowermost end of the pipe.

4. A liquid purge valve according to claim 2, wherein the outlet port comprises an outlet nozzle designed for dispersing water emitted therefrom.

5. A liquid purge valve according to claim 2, wherein the outlet port comprises an outlet nozzle fitted with an audio signaling device activated by a fluid flow therethrough.

6. A liquid purge valve according to claim 2, wherein the housing further comprises a manual override for displacing the sealing member into the open position.

7. A liquid purge valve according to claim 2, adapted for retrofit over the pipe.

8. A liquid purge valve according to claim 2, wherein the tube extends into the pipe till about several centimeters above the mass.

9. A liquid purge valve according to claim 8, wherein the length of the pipe is adjustable.

10. A liquid purge valve according to claim 2, wherein the mass is articulated to the sealing member by a cable extending through at least a portion of the tube.

11. A liquid purge valve according to claim 10, wherein the length of the cable is adjustable.

12. A liquid purge valve according to claim 2, wherein the sealing member is fitted with a pealing seal for gradually detaching from the sealing boundary of the outlet port.

13. A liquid purge valve according to claim 12, wherein the pealing seal is a strip-like resilient member anchored at one end thereof to the housing and at an opposite end thereof to the sealing member.

14. A liquid purge valve according to claim 12, wherein the outlet port has a generally rectangular cross section, wherein the pealing seal displaces about a long axis of the outlet port.

15. A liquid purge valve according to claim 2, wherein said sealing member is fitted with a moment lever articulated at an end thereof distal from said pivot with an arm articulated to the mass and to the biasing member.

16. A liquid purge valve according to claim 15, wherein at the closed, sealing position the moment lever applies a sealing force over the sealing member to sealingly engage the sealing boundary.

17. A liquid purge valve accessory according to claim 16, wherein the length of the mass depends from a cable of an adjustable length, and where the tube is of adjustable length.

* * * * *